US009874369B2

(12) United States Patent
Babur et al.

(10) Patent No.: US 9,874,369 B2
(45) Date of Patent: Jan. 23, 2018

(54) CONSTANT TOTAL ORIFICE AREA DAMPER

(71) Applicants: Nejat Babur, Jersey City, NJ (US); Bart J. Naughton, Alamo, CA (US)

(72) Inventors: Nejat Babur, Jersey City, NJ (US); Bart J. Naughton, Alamo, CA (US)

( * ) Notice: Subject to any disclaimer, the term of this patent is extended or adjusted under 35 U.S.C. 154(b) by 573 days.

(21) Appl. No.: 14/550,763

(22) Filed: Nov. 21, 2014

(65) Prior Publication Data

US 2015/0140922 A1 May 21, 2015

Related U.S. Application Data

(60) Provisional application No. 61/907,011, filed on Nov. 21, 2013.

(51) Int. Cl.
*F24F 13/12* (2006.01)
*F24F 13/06* (2006.01)

(52) U.S. Cl.
CPC ..... *F24F 13/06* (2013.01); *F24F 13/12* (2013.01)

(58) Field of Classification Search
CPC ..... F24F 13/06; F24F 13/12
See application file for complete search history.

(56) References Cited

U.S. PATENT DOCUMENTS 1,740,626 A * 12/1929 Petrelli ..... F24F 13/12 101/24
1,812,595 A * 6/1931 Larson ..... E06B 7/03 454/211
2,470,488 A 8/1943 Honerkamp et al.
2,939,377 A 6/1960 Stach
2,976,795 A 3/1961 Brugler
3,393,627 A * 7/1968 Eurich ..... F24F 13/12 454/324
4,407,187 A * 10/1983 Horney ..... F24F 13/085 454/324
4,852,639 A 8/1989 Horiguchi et al.
5,014,608 A * 5/1991 Benson ..... F24F 3/161 454/187
5,218,998 A * 6/1993 Bakken ..... F24F 13/12 137/625.28
5,427,146 A * 6/1995 Bakken ..... F24F 13/12 137/625.3

(Continued)

*Primary Examiner* — Steven B McAllister
*Assistant Examiner* — Jonathan Cotov
(74) *Attorney, Agent, or Firm* — Shewchuk IP Services, LLC; Jeffrey D. Shewchuk

(57) ABSTRACT

A sliding plate air damper allows control over air flow with the sliding plate having a range of positions which do not change the total area of the orifices through the damper. Openings through the fixed plate and the openings through the sliding plate can each make up about 70% of the active area of each plate. The slide plate can be slid to a position where its webbings divide each fixed plate opening into two orifices for air flow. The air flow can be controlled by selecting the slide position of the webbings from a most restrictive position in which the webbings are in the middle of fixed plate openings, through a range of positions where the orifice on one side of the webbing is larger than the orifice on the other side of the webbing, to a maximally opened position where the webbing on the slide plate overlies the webbing on the fixed plate.

16 Claims, 4 Drawing Sheets

(56) References Cited

U.S. PATENT DOCUMENTS

| | | | | |
|---|---|---|---|---|
| 6,085,834 | A * | 7/2000 | Thomas | F24F 11/027 165/103 |
| 6,192,922 | B1 * | 2/2001 | MacGibbon | F16K 3/085 137/486 |
| 6,302,785 | B1 * | 10/2001 | McKinney | F24F 13/12 160/369 |
| 6,342,004 | B1 * | 1/2002 | Lattimore | A62C 3/16 169/48 |
| 6,712,335 | B1 | 3/2004 | Naughton | |
| 6,786,817 | B2 | 9/2004 | Orendorff | |
| 6,971,631 | B1 | 12/2005 | Naughton | |
| 7,189,158 | B2 * | 3/2007 | Motszko | B60H 1/00378 165/203 |
| 7,431,638 | B2 | 10/2008 | Natsume et al. | |
| 7,597,617 | B2 | 10/2009 | Solberg et al. | |
| 7,733,646 | B2 * | 6/2010 | Hisatsune | H05K 7/20172 174/383 |
| 8,546,703 | B2 * | 10/2013 | Tang | H05K 5/0213 174/547 |
| 2007/0047166 | A1 * | 3/2007 | Creel | F24B 1/192 361/118 |
| 2007/0053143 | A1 * | 3/2007 | Kang | G06F 1/203 361/678 |
| 2011/0147631 | A1 * | 6/2011 | Menassa | F24F 13/12 251/205 |
| 2012/0129443 | A1 * | 5/2012 | Bastow | F24F 13/16 454/258 |

* cited by examiner

CONSTANT TOTAL ORIFICE AREA DAMPER

CROSS-REFERENCE TO RELATED APPLICATION(S)

The present application claims priority from Provisional Application No. 61/907,011, filed Nov. 21, 2013 and entitled "Constant Total Orifice Area Damper". The contents of U.S. provisional patent application Ser. No. 61/907,011 are hereby incorporated by reference in entirety.

FIELD/BACKGROUND OF THE INVENTION

The present invention relates to air flow dampers used to control or affect the flow of air through a duct, into or out of a duct, or between two volumes. For instance, low wall return dampers are used for any return air system to balance the airflow across spaces. A damper installed in a return system can be adjusted from the room side to distribute airflow across the space for proper air recirculation. Similarly, dampers can be used on a duct output such as in a forced air HVAC system to help control the amount of air flow through a particular location.

Such dampers have one or more movable plates which control the characteristic dimensions of one or more orifices through which the air flows. In many dampers, the movable plate(s) rotate about an axis which is transverse to the air flow direction, with the rotation causing the projected amount of surface area of the movable plate restricting air flow (i.e., looking parallel to the air flow direction) to change. In other dampers referred to as slide plate dampers, the plate(s) always extend perpendicular or at least transverse to the air flow direction, and the movement direction of the plate(s) is perpendicular/transverse to the air flow direction. The movement of the slide plate could be linear, or in some instances is rotational about an axis parallel to the air flow direction. The present invention particularly applies to slide plate dampers and similar arrangements, such as disclosed in U.S. Pat. Nos. 5,218,998 and 7,597,617, both incorporated in full by reference, wherein the plates extend generally transverse to the air flow direction through the plate, and wherein the orientation of the plates relative to the air flow direction doesn't change.

For instance, the damper of U.S. Pat. No. 5,218,998 uses two plates with numerous openings in each plate, with flat sides of the plates adjacent or against each other. One plate is generally fixed in place while the other one moves. The relative sliding movement of the plates causes the percentage of the open area in one plate which overlaps with the open area in the other plate to change, i.e, sliding changes the sizes of the orifices through the plate combination. Larger orifices provide less resistance to airflow, smaller orifices provide more resistance to airflow. The combined ribbing of the two plates creates back pressure, which can be used to increase air pressure drop and to direct airflow to other side of the space to create uniform airflow and avoid dead spots.

In such prior art air dampers, the opening size is commonly smaller than the web between openings, so two plates can be aligned to create no orifices and thus be used to fully shut off flow. The general thinking is that the flow resistance is a function (not necessarily a linear function, but still a function) of total orifice area.

BRIEF SUMMARY OF THE INVENTION

The present invention is a sliding plate air damper. The openings through the fixed plate and the openings through the sliding plate are sufficiently large that the active area of the damper provides at least 50% free space. The webbings on the slide plate are smaller in the slide direction that the width of the fixed plate openings, such that with only two plates the air flow cannot be closed off. The slide plate can be slid to a position where its webbings divide each fixed plate opening into two orifices for air flow. The air flow can be controlled by selecting the slide position of the webbings from a most restrictive position in which the webbings are in the middle of fixed plate openings, through a range of positions where the orifice on one side of the webbing is larger than the orifice on the other side of the webbing, to a maximally opened position where the webbing on the slide plate overlies the webbing on the fixed plate. In another aspect, support columns on the fixed plate, which extend across the fixed plate openings in the slide direction and separate the slide plate from the fixed plate, help prevent the webbings on the slide plate from binding into the openings on the fixed plate. The support columns allow use of a thinner slide plate (or narrower webbings on the slide plate) than the fixed plate without flexing of the slide plate becoming a problem.

While the above-identified drawing figures set forth preferred embodiments, other embodiments of the present invention are also contemplated, some of which are noted in the discussion. In all cases, this disclosure presents the illustrated embodiments of the present invention by way of representation and not limitation. Numerous other minor modifications and embodiments can be devised by those skilled in the art which fall within the scope and spirit of the principles of this invention.

DETAILED DESCRIPTION

Figure 1:
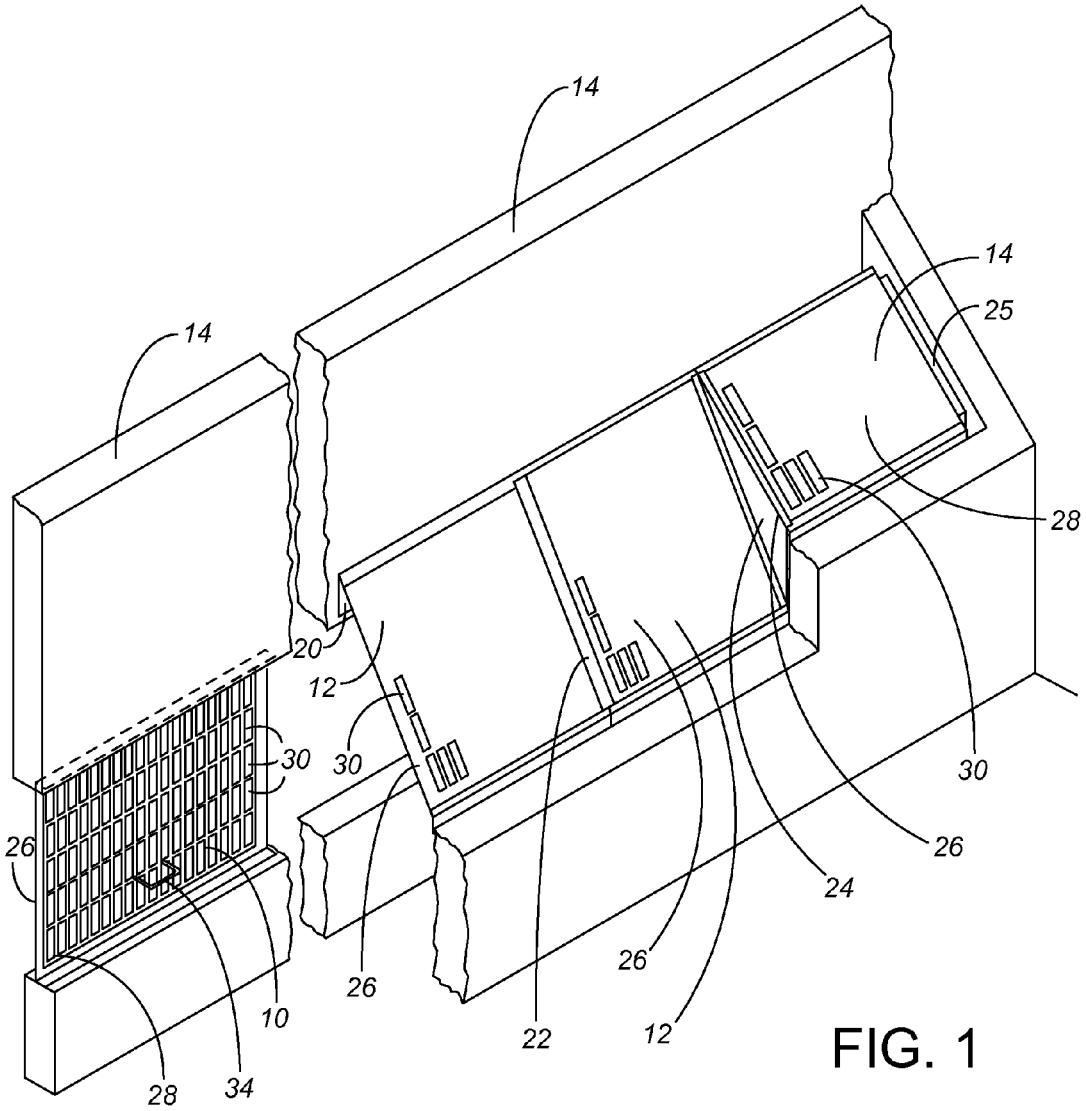
FIG. 1 is a perspective view of an air damper, schematically showing a preferred embodiment with a sixteen foot long section of air damper.

FIG. 1 is a perspective view showing the general construction of several arrangements of air dampers 10, 12, 14 in accordance with the present invention, representing a 16' long section of air damper, with an air flow direction being horizontal through the wall 18 from back to front. On the left hand side, the air damper 10 is arranged vertically in the wall 18. In the middle section of FIG. 1, the air damper 12 is mounted on a 60° supporting wall bracket 20. The wall bracket 20 is mounted on the downstream (return chase) side, toward the back of the drawing as depicted in FIG. 1. A damper to damper connector 22 can be mounted on the upstream (room) side to connect adjacent damper sections 12. On the right hand side of FIG. 1, the air damper 14 is mounted on a 45° supporting wall bracket 24. Preferably each damper 10, 12, 14 is attached to the supporting wall brackets 20, 24 before attaching to the wall 18. After mounting the dampers 10, 12, 14 to the wall 18, a damper end wall bracket 26 can be mounted to further secure the damper 14, such as on the upstream (room) side.

Each damper 10, 12, 14 preferably comprises a fixed plate 26 and a slide plate 28. Because the important concept is that the two plates slide relative to each other, alternatively both of the plates 26, 28 can slide relative to the wall 18. However, a slide plate damper is generally easier to construct with one of the plates being fixed, and for ease of discussion the term "fixed plate" is used to set the frame of reference for the relative movement. Both the fixed plate 26 and the slide plate 28 have an active area with a plurality of openings 30, which are transverse (i.e., extend across) the air flow. As will be further described below with reference to FIGS. 4-7, the locations where the openings 30 on the slide plate 28 overlap the openings 30 on the fixed plate 26 create orifices 32 that the air can flow through.

In the left hand section of FIG. 1, the slide plate 28 is mounted on the downstream (room) side. In the middle section of FIG. 1, the slide plate 28 is mounted on the upstream (return chase) side, with only a few of the openings 30 through the fixed plate 26 illustrated. In the right hand section of FIG. 1, the slide plate 28 is mounted on the downstream (room) side, with only a few of the openings 30 through the slide plate 28 shown. The upstream/downstream orientation of the fixed plate 26 relative to the slide plate 28 is not critical to the present invention, and instead can be selected based on the direction for air flow and need for access to the slide plate 28.

A handle 34 may be attached to the slide plate 28 so the motive force for sliding is hand applied. For a slide plate 28 which is moved by hand, preferably the slide plate 28 is on the more accessible side, i.e., usually the room side. Alternatively, a linkage system (not shown), possibly including an actuator or motor for generating the motive force, can be used to move the slide plate 28. See, for example, the linkage and actuation devices of U.S. Pat. Nos. 4,852,639, 5,014,608, 5,218,998, 5,427,146, 6,786,817 and 7,431,638, each incorporated by reference. The present invention is not particularly concerned with how the slide plate 28 is slid relative to the fixed plate 26, only that some sliding can be achieved to change the orifice configuration through the two combined plates 26, 28. Similarly, the mounting hardware and arrangement is not critical. The present invention can be used with any mounting arrangement, any motive force, and any linkage.

In this configuration shown in FIG. 1, for example, one preferred size of a fixed plate 26 is 38" (vertical)×48" (horizontal), excluding the attachment frame or brackets for mounting. In a preferred embodiment, this leaves an active area on the fixed plate 26 of 36"×46". For use in sliding in the 48" (horizontal) direction on the fixed plate 26, a preferred slide plate 28 has a size of about 37"×45". Alternatively, an arrangement could be constructed where the slide direction is vertical (on the left hand side of FIG. 1) or at 60° (middle section of FIG. 1) or 45° (right hand side of FIG. 1), as long as the two plates 26, 28 have a relative sliding of one plate to the other and extend transverse to the air flow direction through the two plates 26, 28. As another alternative, the slide direction can be rotary, such as disclosed in U.S. Pat. Nos. 2,470,488 and 6,192,922, each incorporated by reference.

The active area on the fixed plate 26 is split into a 19 (in the slide direction)×5 array of openings 30 (not separately shown in FIG. 1), with ribbings 36 (not separately shown in FIG. 1) between the openings 30 to provide sufficient strength to the overall structure. In the preferred embodiment, the ribbings 36 are about ⅔" wide, leaving openings 30 which are about 6⅔" long×1.8" wide in the slide direction. The preferred slide plate 28 includes identically sized, shaped and spaced openings 30 and ribbings 36, although the matching array is only 18 (in the slide direction)×5, with all 90 slide plate openings 30 drawn in FIG. 1.

The plates 26, 28 are preferably formed of metal, such as 304 stainless steel, 316L stainless steel, aluminum or cold rolled steel. If formed of steel, the fixed plate 26 has a preferred thickness of 18 gauge, and the slide plate 28 has a preferred thickness of 20 gauge. If formed of aluminum, the fixed plate 26 has a preferred thickness of 0.125 inches, and the slide plate 28 has a preferred thickness of 0.060 inches. In such configuration when the slide plate 28 is thinner than the fixed plate 26, the slide plate 28 is preferably mounted on the upstream side, so any flexing of the slide plate 28 (i.e., more flexing of the slide plate 28 than of the fixed plate 26) due to air flow will not increase separation between the two plates 26, 28. Such mounting preference however must be weighed against the need for access to the slide plate 28.

Figure 2:
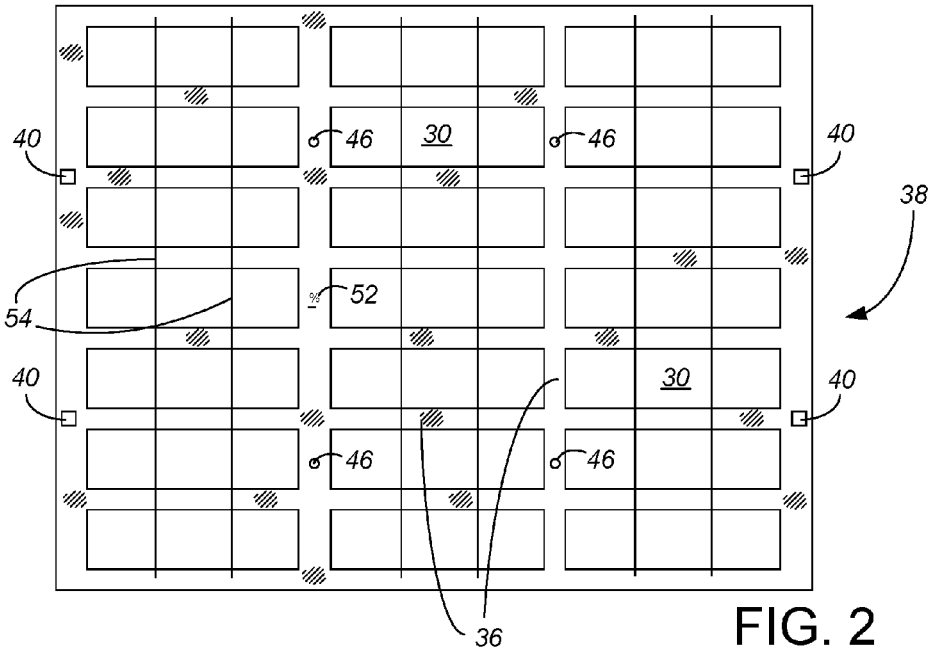
FIG. 2 is a front view of a fixed plate which can be used in the air damper of the present invention.

FIG. 2 shows more detail of a smaller version of a fixed plate 38, having an array of only 7 (in the slide direction)×3 openings 30. The construction details of this smaller version are fully applicable to the larger versions shown in FIG. 1. Four brackets 40 can be welded to the fixed plate 38 or punched/bent into the fixed plate 38 for holding the edges 42 of the slide plate 44 to the fixed plate 38. Four holes 46 in the middle slide-direction ribbing 36 are provided for fasteners 48, 50 (shown in FIGS. 3-7) to further support the slide plate 44. A marking 52, this one provided as a short line with a marking "%" to indicate "percent open", is also provided on the fixed plate 38.

Depending upon the velocity of the air flow, the desired thickness of the slide plate 44 and/or fixed plate 38 may be too thin to prevent flexing of the ribbings 36. If ribbings 36 flex into the openings 30 of the other plate, the plates 38, 44 can bind and prevent sliding back to a position where the ribbings 36 on the two plates 38, 44 overlap. To prevent the flexing-ribbing-causing-binding situation, separator columns 54 extending in the slide direction are an optional addition to the preferred embodiment, as shown in FIGS. 2 and 4-7. The preferred separator columns 54 are thin strips of wire secured to the fixed plate 38, separating the fixed plate 38 from the slide plate 44.

Figure 3:
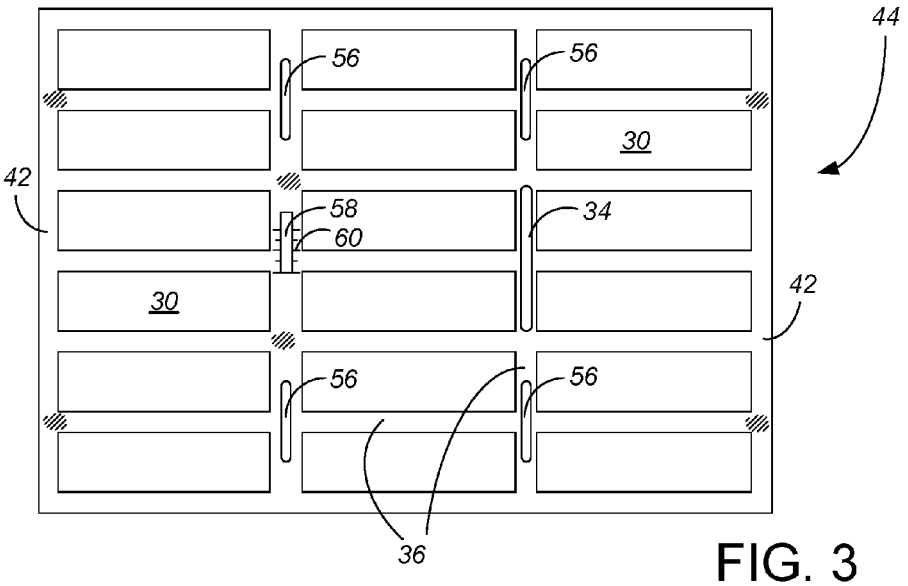
FIG. 3 is a front view of a slide plate which can be used in the air damper of the present invention to mate with the fixed plate of FIG. 2.

FIG. 3 shows more detail of a smaller version of a slide plate 44, having an array of only 6 (in the slide direction)×3 openings 30, for use with the fixed plate 38 of FIG. 2 and shown in FIGS. 4-7. The slide plate 44 includes five additional slots 56, 58 in the slide-direction ribbing 36. Four of these slots 56 receive support fasteners 48, 50 in conjunction with the four holes 46 in the fixed plate 38. The fifth slot 58 is a sight window. Markings 60 can be provided adjacent the sight window 58. A handle 34 is also provided, such as welded to the slide plate 44.

FIGS. 4-7 show operation of the damper using the fixed plate 38 of FIG. 2 and the slide plate 44 of FIG. 3. The slide plate 44 is attached to the fixed plate 38 by the four brackets 40 on the edges 42 as well as with three of the slots 56 used to attach a slide connector 48. The preferred slide connector 48 has a head which is wider than the slots 56 but which is not tightened down and therefore freely allows sliding. A wing nut 50 and bolt is used in the fourth slot 56. When the wing nut 50 is hand tightened, it secures the slide plate 44 in position relative to the fixed plate 38. When the user wants to adjust the position of the slide plate 44 relative to the fixed plate 38, the user merely loosens the wing nut 50 and hand slides the slide plate 44 using the handle 34. The bolt for the wing nut 50 can either extend through the fixed plate 38 or can be a stud welded to the fixed plate 38. As an alternative to the handle 34, with the locking wing nut 50 absent or loosened, the slide plate 44 can be slid relative to the fixed plate 38 via inserting and pulling with a screw driver (not shown).

Figure 4:
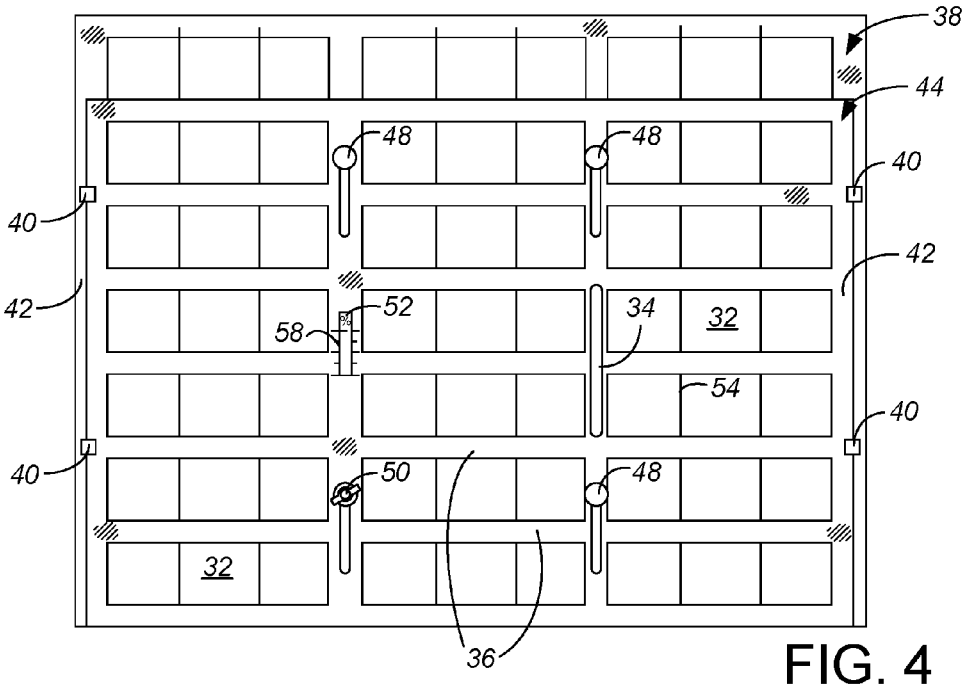
FIG. 4 is a front view showing a damper using the fixed plate of FIG. 2 and the slide plate of FIG. 3 in an air damper, with the slide plate positioned fully opened.

The progression of FIGS. 4 through 7 shows various positions of the slide plate 44 relative to the fixed plate 38. In FIG. 4, the slide plate 44 is at a fully opened position. The marking 52 on the fixed plate 38, visible through the sight window 58, is at the 100% open mark on the slide plate 44. The air flow openings 30 in the slide plate 44 overlap exactly with the air flow openings 30 in the fixed plate 38. For the configuration shown in FIG. 4, with a preferred air flow opening size of 6⅔" long×1.8" wide and ribbings 36 of about ⅔" wide (except for the ribbing 36 containing the sight window 58, which is about 1" wide), this means a total orifice size of about 252 $in^2$ in the active area of about 360 $in^2$, i.e. the 21 orifices 32 (ignoring the separator columns 54) make the active area about 70% open, which is as wide open as this particular configuration of damper can get. In this preferred embodiment, with the air flow openings 30 on both the fixed plate 38 and the slide plate 44 being the same size, shape and layout, both the active area of the fixed plate 38 and the slide plate 44 are about 70% free space. For other embodiments, if the size or number of openings 30 on one plate is larger than on the other plate, then the amount of free space will differ between the two plates. In preferred embodiments, the active areas on both the fixed plate 38 and on the slide plate 44 provide more than 50% free space, with the combined plates 38, 44 providing orifices 32 which are more than 50% open.

Figure 5:
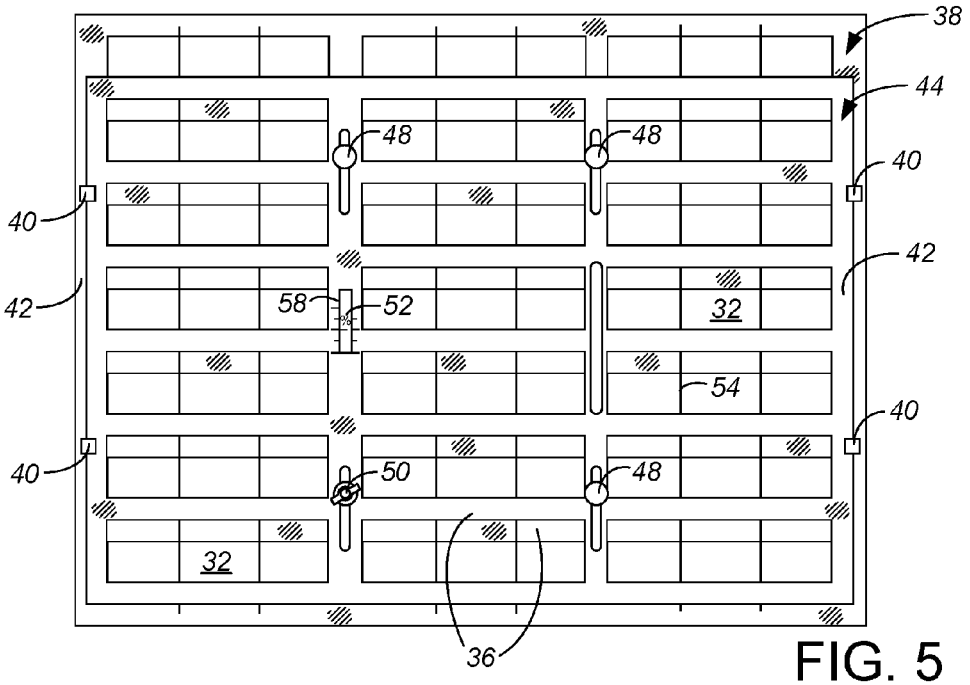
FIG. 5 is a front view similar to FIG. 4, with the slide plate positioned about half way closed.

In FIG. 5, the slide plate 44 has been slid upward, to a position where the bottom of the horizontal ribbing 36 on the slide plate 44 is exactly at the elevation of the top of the horizontal ribbing 36 on the fixed plate 38. The marking 52 on the fixed plate 38, visible through the sight window 58, is at about the 50% open mark on the slide plate 44. Each orifice 32 now, instead of being 1.8" wide, is only about 1.13" wide. The total orifice size is now about 158 $in^2$, i.e., the orifices 32 make the active area about 44% open.

Figure 6:
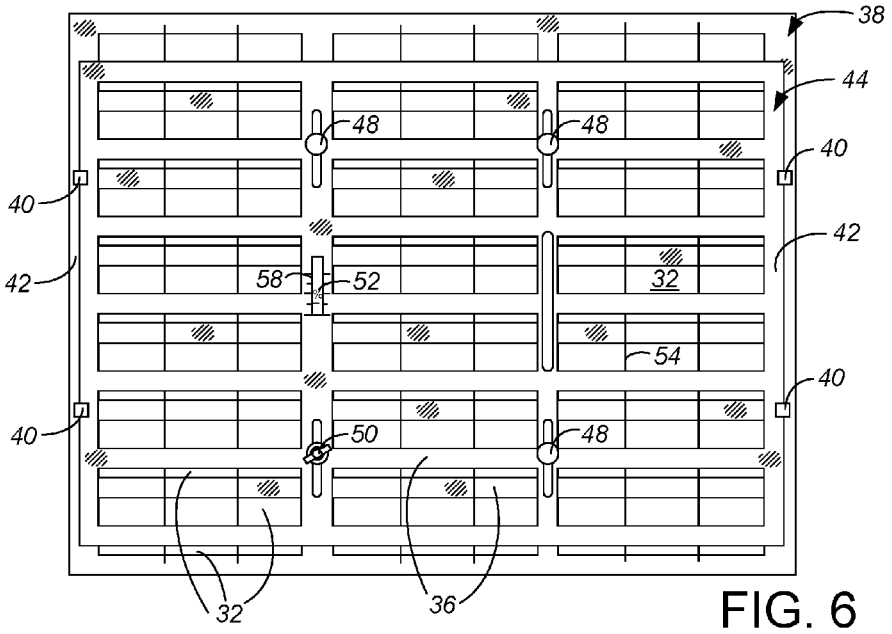
FIG. 6 is a front view similar to FIGS. 4 and 5, with the slide plate positioned more than half way closed.

In FIG. 6, the slide plate 44 has been slid further upward. Now each horizontal ribbing 36 on the slide plate 44 is at a position where it divides the corresponding opening 30 on the fixed plate 38 into two different orifices 32. The total orifice size is still about 158 $in^2$, but the number of orifices 32 has doubled, now to 42. The marking 52 on the fixed plate 38, visible through the sight window 58, is just over the 25% open mark on the slide plate 44. The orifices 32 below the horizontal ribbing 36 on the slide plate 44 make up about 25% of the total orifice area, while the orifices 32 above the horizontal ribbing 36 on the slide plate 44 make up about 75% of the total orifice area. An important realization leading to the present invention is the discovery that the damper in the configuration of FIG. 6 provides significantly more resistance to air flow than the damper in the configuration of FIG. 5, despite having the identical total orifice area.

Figure 7:
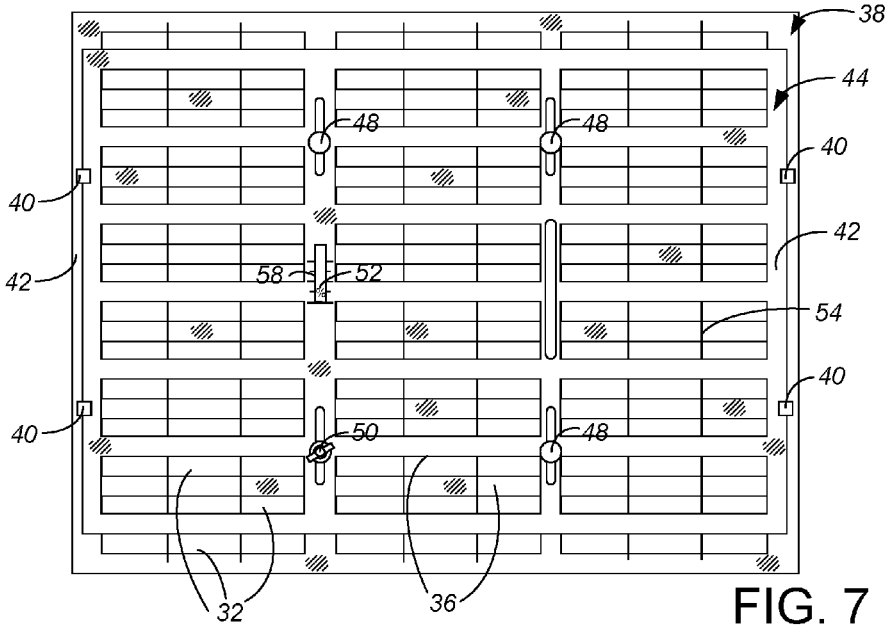
FIG. 7 is a front view similar to FIGS. 4-6, with the slide plate positioned fully closed.

In FIG. 7, the slide plate 44 has been slid further upward. Now each horizontal ribbing 36 on the slide plate 44 is at a position where it divides the corresponding opening 30 on the fixed plate 38 into two different orifices 32, exactly in half. The total orifice size is still about 158 $in^2$ and the total number of orifices 32 remains 42. The marking 52 on the fixed plate 38, visible through the sight window 58, is at the 0% open mark on the slide plate 44. The orifices 32 below the horizontal ribbing 36 on the slide plate 44 make up about 50% of the total orifice area, while the orifices 32 above the horizontal ribbing 36 on the slide plate 44 make up 50% of the total orifice area. Another important realization leading to the present invention is the discovery that the damper in the configuration of FIG. 7 provides significantly more resistance to air flow than the damper in the configuration of FIG. 6, despite having the identical total orifice area and the identical number of orifices 32. In other words, despite have a constant total orifice area in each of the configurations of FIGS. 5-7, the damper of the present invention still allows significant airflow control.

From the configuration of FIG. 4 to the configuration of FIG. 7, the throw of the slide plate 44 is about 1¼". The preferred configuration allows the slide plate 44 to be slid even further upward, for a total throw of 1.8", until the ribbing 36 on the slide plate 44 is at the top of the opening 30 on the fixed plate 38. This results in retracing the air flow resistance curve back to the resistances provided by the configurations of FIGS. 6 and 5, but slightly affects the upward/downward vector of airflow through the damper. Over the entire throw of the slide plate 44, the air flow orifices 32 cannot be fully closed, because the openings 30 are too large relative to the slide-direction ribbing width. The preferred configuration shown in the 36"×48" damper shown on the left hand side of FIG. 1 has been tested to confirm its resistance to air flow. At a given undampened air flowrate, when the damper was fully opened (i.e., in an orifice configuration similar to FIG. 4), it provided a pressure drop of 0.07 psi (pressure drop calculations based on Idelchik pressure drop handbook). When the damper was moved to an orifice configuration similar to FIG. 5, it provided a pressure drop of 0.204 psi. When the damper was moved to a fully closed position with an orifice configuration similar to FIG. 7 (i.e., having the identical total orifice area as the 0.204 psi pressure drop), if provided a pressure drop of 0.375 psi.

For the more than half of the slide plate throw, sliding the slide plate 44 horizontally relative to the fixed plate 38 does not change the total amount of orifice surface area through the plate combination, but rather only changes the size of half of the orifices 32 relative to the size of the other half of the orifices 32 through the plate combination.

The purpose of the preferred damper is not to create a shut off but change the number of orifices 32 and more importantly change the relative orifice sizes to create back pressure to increase air pressure drop to direct airflow to other side of the space to create uniform airflow and avoid dead spots.

Increasing the number of orifices 32 and not having a zero shut off increases the free area similar to perforated plate design. When the preferred damper is fully open, more than 63% free area is achieved (about 68% of the active area, with less than 4% lost on the border around the active area). When the moving plate 44 slides over the fixed plate 38 the orifice areas get smaller because the ribs 36 between orifices 32 are not aligned over one another, and pressure drop is increased. In this case still the same number of orifices 32 are achieved however the free area drops down to 48%, creating more back pressure. When the moving plate 44 continues to move to the middle position, the ribs 36 between the sliding plate openings 30 split the fixed plate openings 30, doubling the number of orifices 32. Even though the total area of the orifices 32 is the same (48%) as when the rib 36 is fully exposed and blocking one side of the opening 30, the pressure drop continues to increase until the rib 36 is in a middle position and the two orifices 32 are half the size of the single (rib 36 blocking one side as shown in FIG. 5) orifice 32. More back pressure is created by having twice as many, but much smaller orifices 32. The damper is designed to allow continuous positioning of the slide plate 44 between 100% open (63% free area) to greatest pressure drop (48% free area, orifices 32 in combined plates 38, 44 having equal areas).

Having more free area allows the designer to use higher air velocities in the return walls. Having low pressure drops between different positions also allows the designer to be able to distribute the airflow across the space and does not penalize a recirculation fan with extra pressure drop, thereby decreasing the energy consumption and noise.

In some circumstances the designer may desire to have a fully closed off damper setting, which cannot be achieved with a two plate design in accordance of the present invention. The concepts of the present invention can be used in a full shut-off damper simply by using more than two plates. For example, using the preferred opening width of 1.8" and a slide-direction ribbing width of ⅔", three slide plates 44 can be used in conjunction with a single fixed plate 38 to provide a full shut-off. The number of slide plates 44 necessary to fully shut off the air flow depends upon the relative dimensions of the opening width to the slide-direction ribbing width. A relatively narrower slide-direction ribbing width allows for a greater fully open flow, but requires more plates for full shut-off.

Although the present invention has been described with reference to preferred embodiments, workers skilled in the art will recognize that changes may be made in form and detail without departing from the spirit and scope of the invention. For example, all the dimensions provided herein are exemplary only, and can be varied for the particular system in which the damper of the present invention is used. While the preferred embodiments use a rectangular array of rectangularly-shaped openings 30, other arrangements of openings can be used as well as other shapes of opening, such as the opening shapes and arrays of U.S. Pat. Nos. 5,014,608, 5,218,998, and 5,427,146 (but with larger opening widths relative to the slide-direction ribbing width).

What is claimed is:

1. An air damper, comprising:

a first plate arranged transversely to an airflow direction, the first plate having a plurality of first plate openings defined therein for air to possibly flow through;

a slide plate arranged transversely to an airflow direction, the slide plate having a plurality of slide plate openings defined therein for air to possibly flow through, the slide plate being movable in a slide direction which is transverse to the airflow direction, with the slide plate supported such that sliding movement of the slide plate relative to the first plate changes the size of dual plate air flow orifices defined by overlapping portions of the first plate openings and the slide plate openings;

wherein the first plate openings and the slide plate openings have a sufficiently large width in the slide direction that a complete throw of the slide plate, over a throw distance larger than the width of the first plate openings and also larger than the width of the slide plate openings, does not substantially close the dual plate air flow orifices, but instead leaves air flow paths through at least some of the dual plate air flow orifices at all possible locations of the slide plate relative to the first plate.

2. The air damper of claim 1, wherein the first plate is a fixed plate having the plurality of first plate openings defined in a first plate array having of a first plate plurality of columns each aligned in the slide direction and a first plate number of rows including a first row and a last row, and wherein the plurality of slide plate openings are defined in a slide plate array having of a slide plate plurality of columns each aligned in the slide direction and a slide plate number of rows which differs from the first plate number of rows.

3. The air damper of claim 1, wherein the first plate openings have an equal size and shape as the slide plate openings, and wherein a total number of first plate openings is different than a total number of slide plate openings.

4. The air damper of claim 1, wherein the first plate openings are rectangular openings arranged in a rectangular array with ribbing between the openings, the ribbing having a ribbing width in the slide direction, wherein the width of the slide plate openings is greater than the ribbing width, and wherein the complete throw of the slide plate is over a distance less than a total of the width of the slide plate openings plus the ribbing width.

5. The air damper of claim 1, wherein the sliding movement is linear, and further comprising a sight window on the slide plate with at least one marking on the first plate visible through the sight window.

6. The air damper of claim 1, wherein an outline of all the first plate openings define a first plate active area which is more than 50% free space, and wherein an outline of all the slide plate openings defining a slide plate active area which is more than 50% free space.

7. The air damper of claim 1, further comprising a handle attached to the slide plate for hand movement of the slide plate.

8. An air damper, comprising:

a first plate arranged transversely to an airflow direction, the first plate having a number of first plate openings defined therein for air to possibly flow through;

a slide plate arranged transversely to an airflow direction, the slide plate having webbings which define a plurality of slide plate openings therebetween for air to possibly flow through, the slide plate being movable in a slide direction which is transverse to the airflow direction, with the slide plate supported for sliding movement of the slide plate relative to the first plate, the webbings having a webbing width in the slide direction;

wherein the webbing width in the slide direction is smaller than widths of first plate openings in the slide direction, such that the webbings can divide each first plate opening with an orifice on opposing sides of the corresponding webbing, and wherein the first plate openings define a first plate active area with a first plate active area width, and wherein a complete throw of the slide plate is less than the first plate active area width.

9. The air damper of claim 8, wherein the slide plate openings are sized and arranged to be at least as large as the first plate openings, and wherein the slide plate can be slid to only one fully opened position wherein the webbings provide no additional resistance to air flow beyond resistance provided by the first plate.

10. The air damper of claim 8, wherein the first plate openings are sized and arranged to be at least as large as the slide plate openings, and wherein there are more first plate openings than slide plate openings.

11. The air damper of claim 8, further comprising:

a sight window on the slide plate with at least one marking on the first plate visible through the sight window;

at least one marking on the slide plate adjacent the sight window to judge sizes of orifices on one side of the webbings relative to sizes of orifices on the opposing side of the webbings; and a fastener for securing the slide plate at any selected position relative to the first plate such that relative sizes of orifices on one side of the webbings can be controlled relative to sizes of orifices on the opposing side of the webbings.

12. The air damper of claim 8, further comprising a plurality of support columns attached to the first plate, the support columns being disposed between the first plate and the slide plate and extending across first plate openings in the slide direction, the support columns preventing the webbings from flexing into the first plate openings and thereby preventing the slide plate from binding against sliding movement on the first plate.

13. The air damper of claim 12, wherein the support columns are wires.

14. An air damper, comprising:

a first plate arranged transversely to an airflow direction, the first plate having a number of first plate openings defined therein for air to possibly flow through;

a slide plate arranged transversely to an airflow direction, the slide plate having webbings which define a plurality of slide plate openings therebetween for air to possibly flow through, the slide plate being movable in a slide direction which is transverse to the airflow direction, with the slide plate supported for sliding movement of the slide plate relative to the first plate; and a plurality of support columns attached to the first plate and extending across a surface of the first plate, the support columns being disposed between the first plate and the slide plate and extending across first plate openings in the slide direction, the support columns preventing the webbings from flexing into the first plate openings and thereby preventing the slide plate from binding against sliding movement on the first plate.

15. The air damper of claim 14, wherein the support columns are wires.

16. The air damper of claim 14, wherein the slide plate is formed of a thinner material than the fixed plate.

* * * * *